United States Patent [19]

Terzian et al.

[11] Patent Number: 4,799,678

[45] Date of Patent: Jan. 24, 1989

[54] ELECTRONIC GAME WITH ANIMATED HOST

[75] Inventors: Rouben T. Terzian, Chicago; Jeffrey D. Breslow, Highland Park; Donald A. Rosenwinkel, Oak Park; John V. Zaruba, Chicago, all of Ill.

[73] Assignee: Marvin Glass & Associates, Chicago, Ill.

[21] Appl. No.: 12,084

[22] Filed: Feb. 6, 1987

[51] Int. Cl.[4] ..... A63F 9/00; A63H 13/00

[52] U.S. Cl. ..... 273/1 E; 273/237; 273/240; 273/85 G

[58] Field of Search ..... 273/236, 237, 273, 281, 273/289, 85 E, 85 G, DIG. 28, 1 E; 446/297, 300, 301; 360/79; 369/70, 19, 20, 31; 40/457, 414, 415, 416, 417, 418, 470, 471, 472, 473, 474, 475; 434/309

[56] References Cited

U.S. PATENT DOCUMENTS

| | | | |
|---|---|---|---|
| 2,871,593 | 2/1959 | Roberts | 40/416 |
| 3,767,901 | 10/1973 | Black et al. | 235/151 |
| 4,189,779 | 2/1980 | Brautingham | 273/237 |
| 4,642,710 | 2/1987 | Murtha et al. | 360/79 |
| 4,690,645 | 9/1987 | Ukisu | 434/309 |

*Primary Examiner*—Leo P. Picard
*Assistant Examiner*—Jessica J. Harrison
*Attorney, Agent, or Firm*—John S. Pacocha

[57] ABSTRACT

An electronic game playing device including an animated character and a synthesized voice. Game play instructions, required responses and awards, are contained in a program memory within a base on which the character is mounted. Carried by the base are a player input touch pad including the letters of the alphabet and individual player input buttons as well as a gridwork of lightable spaces. Animation of different features of the character is initiated at different times in response to audio signals emanating from the voice synthesis, or from an interfaced tape player, through an animation drive powered by a single motor. The animiation drive includes a shaft carrying relatively rotatable components some of which are rotated by other of the components after a predetermined amount of rotation by such other components. Movement of the character's mouth is accomplished by a second motor having a drive engaging the edge of an inner extension of the lower jaw.

13 Claims, 7 Drawing Sheets

338
GAME A
348
INPUT SKILL LEVEL
356
SELECT PHRASE
350
LEVEL 1
NO
352
LEVEL 2
NO
354
LEVEL 3
358
LIGHT BLANKS
360
REVERSE ORDER
364
SPIN
362
SELECT FIRST PLAYER
366
BUSTED
NO
370
LOSE TURN
NO
372
STORE AMOUNT
YES
368
LOSE MONEY
374
GUESS CONSONANT
378
NEXT PLAYER
YES
376
VOWEL
NO
380
CORRECT
NO
YES
YES
382
PICK UP MONEY
388
ANNOUNCE WINNER
YES
386
CORRECT
NO
YES
384
GUESS PHRASE
NO
390
GUESS ANY LETTER

ELECTRONIC GAME WITH ANIMATED HOST

BACKGROUND OF THE INVENTION

1. Field of the Invention

This invention relates generally to games and animated characters and more particularly to a game having an electronic program and an animated game host character.

2. Background Art

Game shows are presently a very popular form of entertainment. The prior art includes electronic games such as that disclosed in Morrison et al. U.S. Pat. No. 4,207,087 issued June 10, 1980 in which an electronic device indicates sequences of light and sound that players attempt to recall and duplicate. An electronic question and answer game is disclosed in Orenstein U.S. Pat. No. 4,372,554 issued Feb. 8, 1983. There have been prior art dolls, such as those disclosed in Terzian et al., U.S. Pat. 4,507,098 issued Mar. 26, 1985, U.S. Pat. No. 4,467,555 issued Aug. 28, 1984 and Herbstler et al. U.S. Pat. No. 4,563,163 issued Aug. 28, 1984 that are animated to roller skate, swim, and rise from a prone position, respectively. Genin U.S. Pat. No. 3,888,023 issued June 10, 1975 discloses a physical trailing robot instructor programmed to demonstrate calisthenic exercises while Morrison et al. U.S. Pat. No. 4,027,425 issued June 7, 1977 discloses an animated band which dances in response to music from a phonograph. Animation of a character's face in response to audio input is disclosed in Villa U.S. Pat. No. 4,177,589 issued Dec. 11, 1979. However, there remains a need for a combination of an electronic game device interacting with an animated character to simulate a game show.

SUMMARY OF THE INVENTION

The present invention is concerned with providing an electronic game playing device with a synthesized voice and an animated game show host character. A base for the character simulates a stage and houses required electronic components as well as a gridwork of indicator lights plus a touch switch pad of thirty-two squares and individual player buttons. Animation of different features of the character such as its eyes, head and arms, all powered by a single motor, are initiated at different times in response to the synthesized voice or the output of an audio tape. The animation drive from the one motor includes a shaft carrying relatively rotatable components, some of which are rotated by other of the components carried by the shaft after a predetermined amount of rotation by such other components. Another motor has a drive engaging an edge of an inner extension of a lower jaw to open and close the lower jaw of the character's mouth in simulated synchronization with the synthesized voice or an audio tape. Interface of a separate audio tape player with a microprocessor program included in the electronic components housed in the base expands the number, and types, of games playable with this device.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
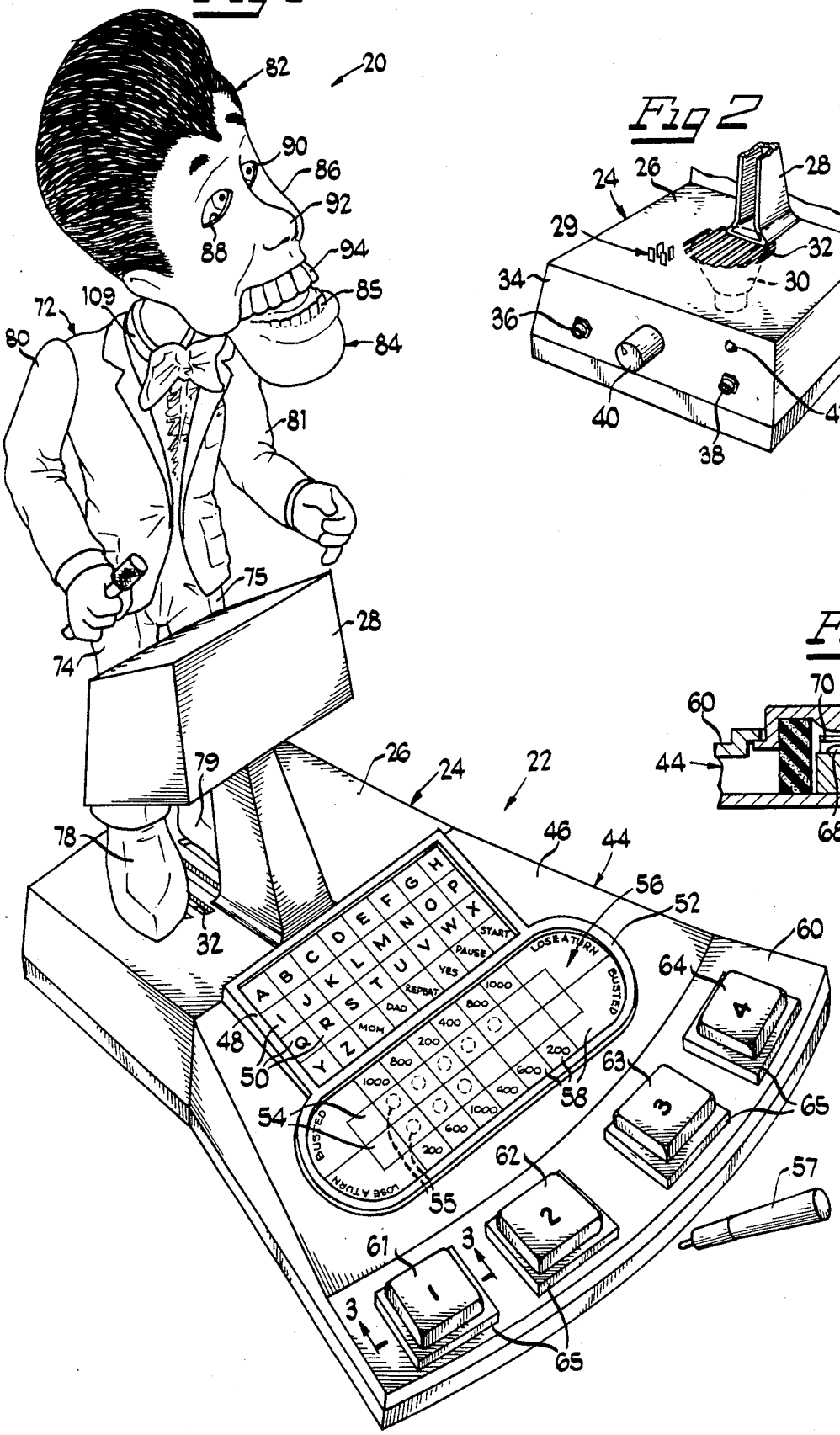
FIG. 1 is a perspective view of an embodiment of the present invention.

Referring now to the drawings in which like parts are designated by like reference numerals throughout the several views, a character 20 and a game playing base 22 are shown in FIG. 1. Base 22 includes a rearward platform 24 having a substantially flat top 26 on which a podium 28 is secured and character 20 is removably attached. For connecting character 20, there is an upstanding male plug 29 in platform 24 that projects above top 26. Housed within platform 24 is a speaker 30 illustrated in FIG. 2 directed upwardly so that sound comes out of a grill 32 in top 26.

Figure 2:
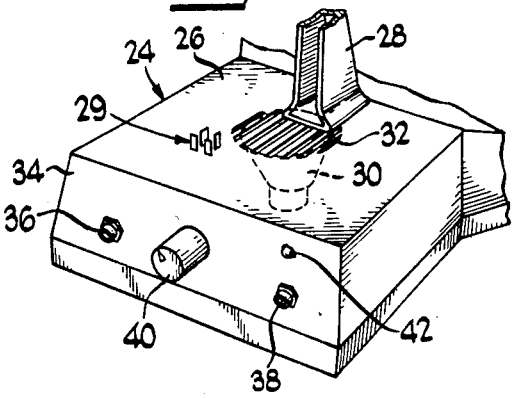
FIG. 2 is a rear, perspective view of part of the base without the character shown in FIG. 1.

As shown in FIG. 2, platform 24 has a backwall 34 in which there are a power pack input 36, a jack 38 for input from an audiocassette player or a microphone, a sensitivity control knob 40 and an LED 42. Both the game and character of this preferred embodiment require a DC power supply. Conveniently, the required power may be obtained from batteries (not shown), housed within base 22, or from a conventional plug-in AC adapter (not shown) having a six volt, three hundred milliampere DC output and a connector compatible with input 36.

Forward of platform 24, base 22 includes a game display portion 44, having a slanted surface 46 angling downwardly from top 26 of platform 24. On the slanted surface, adjacent the upper rear of portion 44 is a raised rectangular rim 48. Within rim 48 are thirty-two generally square touch pads 50. One of each of the letters of the alphabet or the words "MOM", "DAD", "REPEAT", "YES", "PAUSE" and "START" identify each one of the key pads. Each one of the thirty-two pads 50 controls a switch (not shown). Although a membrane type touch switch pad is preferred, each of the squares 50 could be independently movable to close a switch upon depression.

Disposed below, and partially contiguous with, raised rectangular rim 48 is a raised oval rim 52. Generally centrally disposed within oval rim 52 is a two row rectangular grid of sixteen squares 54 on a translucent material. Beneath each square 54 is a separate light source 55 such as an LED. Surrounding the grid of lightable squares 54, is a removable insert 56 having a central rectangular transparent portion or a cutout portion overlying squares 54. Players may write directly on squares 54, or a transparent portion of insert 56 overlying the squares, with an erasable marker 57 such as a SANFORD'S EXPO Dry Erase Marker. Around the periphery of insert 56 are a number of areas 58, each of which is conveniently aligned with a single one of squares 54. Areas 58 contain numerical indications or other instructions pertaining to play of a game.

Figure 3:
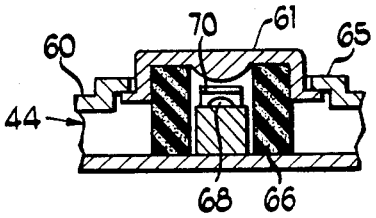
FIG. 3 is an enlarged scale, sectional view taken generally along line 3—3 of FIG. 1.

At its forward edge, slanted surface 46 joins an arcuate surface 60 that is generally parallel to, but spaced lower than, top 26. Housed adjacent the front of game display portion 44 are four player buttons 61, 62, 63 and 64. Surrounding each of the projecting buttons is a bezel 65. Each of the buttons which are preferably formed of a translucent material are identical except for color and an identifying material. By way of example, FIG. 3 shows a sectional view through player button 61. A hollow resilient cushion 66 urges each of the buttons upwardly to project above surface 60 and bezel 65. Within the hollow of each cushion 66, is a bulb or LED 68 that is selectively energized by depression of a button 61, 62, 63 or 64 against the bias of its respective resilient cushion 66 to push down upon and close an upwardly biased blade 70 of a switch. Depression of switch blade 70 completes a circuit (not shown) to energize a bulb or LED 68 from the power source (not shown).

Figures 4, 5, 6:
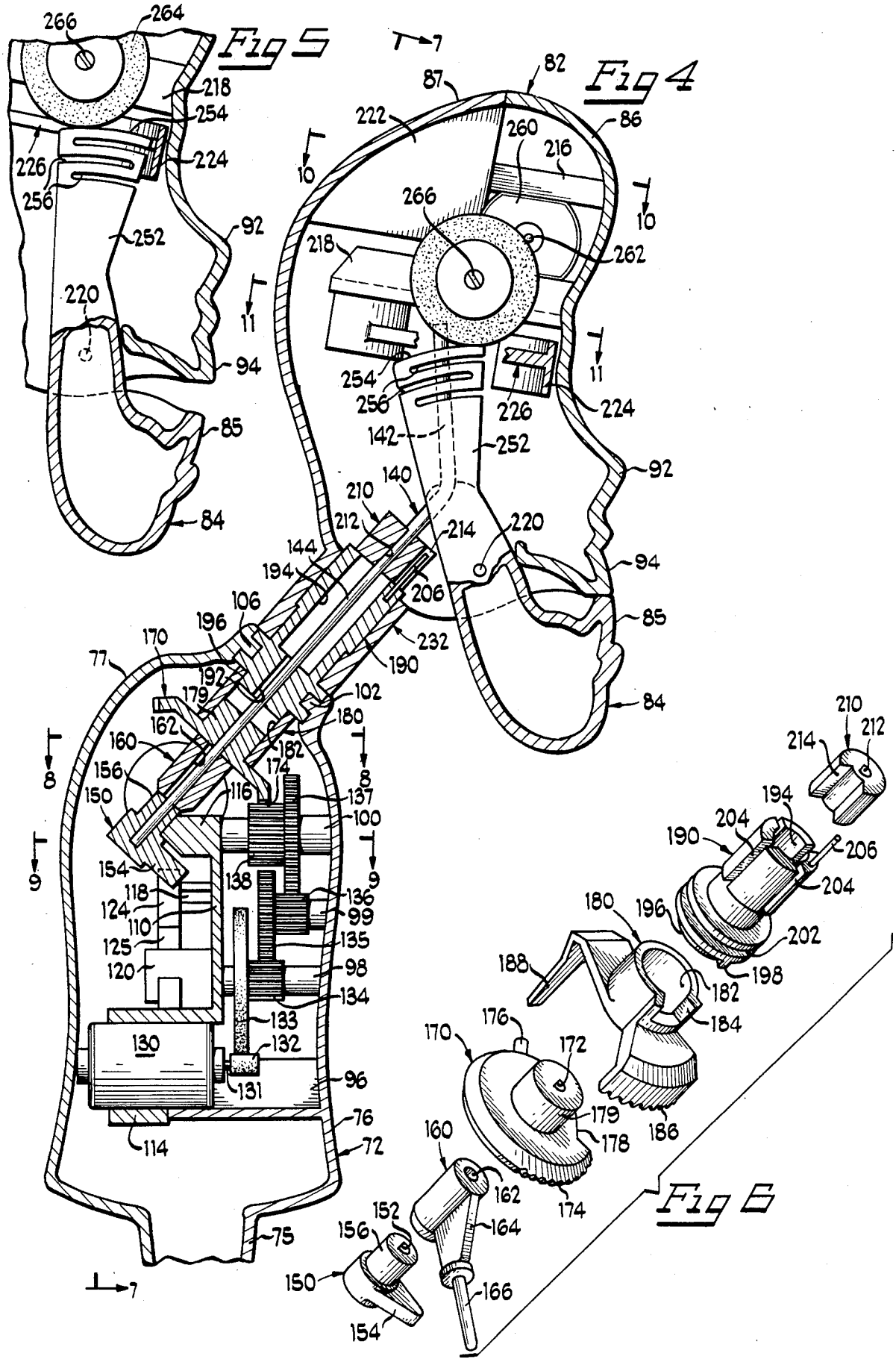
FIG. 4 is a vertical sectional view through the head and upper torso of the character shown in FIG. 1.
FIG. 5 is a fragmentary vertical sectional view through the head, similar to that of FIG. 4 but showing the lower jaw open.
FIG. 6 is a exploded perspective view of some of the components.
Figure 7:
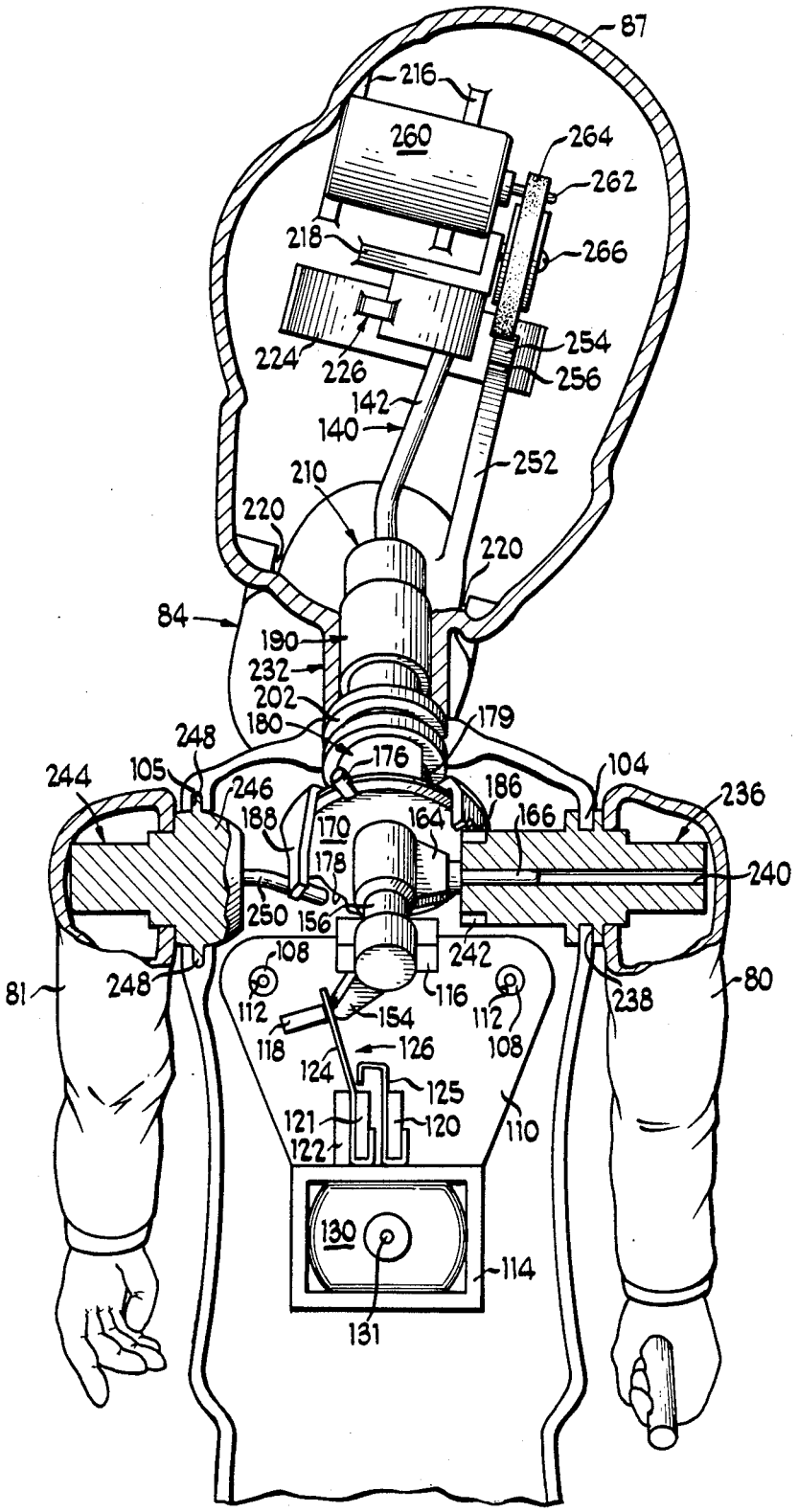
FIG. 7 is a sectional view taken generally along line 7—7 of FIG. 4.
Figure 10:
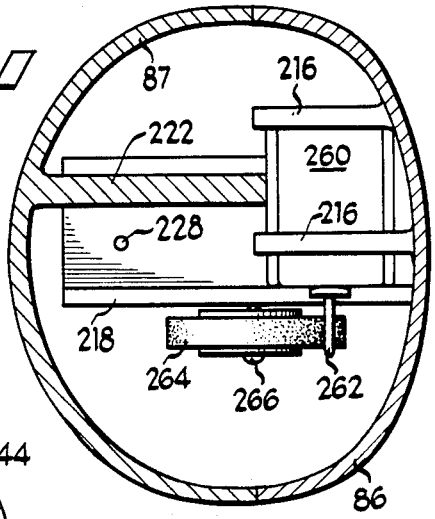
FIG. 10 is a sectional view taken generally along line 10—10 of FIG. 4.

Character 20 shown in FIG. 1 has a torso 72 with integral right and left legs 74 and 75 formed, as illustrated in FIG. 4 of a front part 76 and a rear part 77. On the bottom of each leg is a respective right foot 78 and a left foot 79. In the bottom of left foot 79 is a female plug (not shown) that mates with male plug 29 in platform 24, to attach the character on top 26. Mounted for pivotal movement about the shoulders of torso 72 are a right arm 80 and a left arm 81. Connected to the torso for generally side-to-side movement in an arcuate path is a head 82 with a movable lower jaw 84 with teeth 85. Head 82, except for lower jaw 84, is formed of a front shell 86 and a rear shell 87 which is shown in FIGS. 4 and 7. Openings 88 are provided in front shell 86 for a pair of laterally movable eyes 90. In addition, front shell 86 provides a nose 92 and upper teeth 94.

FIG. 4 shows that projecting inwardly from front torso part 76 are a motor support shelf 96 plus bosses 98, 99 and 100. At the top neck portion, front torso part 76 has a semicircular opening with an inwardly directed neck flange 102. Also integrally formed as part of front part 76, as illustrated in FIG. 7, is a semicircular opening with an inwardly directed flange 104 for mounting right arm 80 for rotation and a semicircular opening with an internal groove 105 for pivotally mounting left arm 81. Rear torso part 77 also has, as shown in FIG. 4, a neck portion with a semicircular opening and an inwardly directed neck flange 106 as well as a mating right arm semicircular opening with a flange 107 shown in FIG. 8 and a left arm mounting semicircular opening and groove (not shown). In addition, both the front and rear torso parts have a number of cooperating integrally formed mounting posts that are not shown except for two of such posts 108 appearing in FIG. 7. Helping to secure the front and rear torso parts together at the upper neck end is a bow tie band 109 illustrated in FIG. 1 that fits snugly over the neck portions of the two torso parts.

Figure 8:
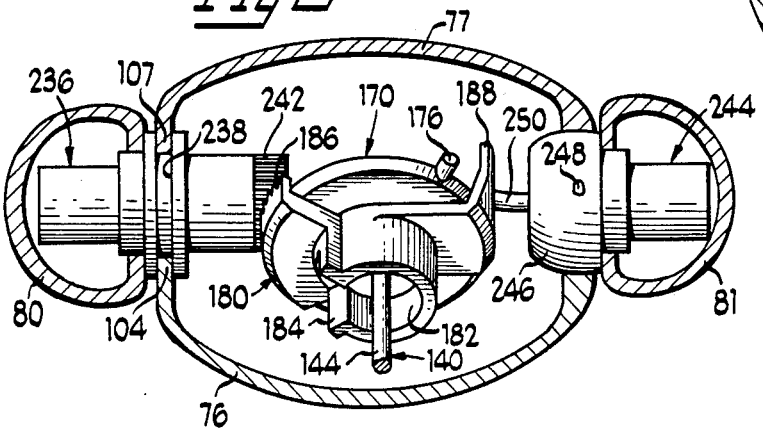
FIG. 8 is a sectional view taken generally along line 8—8 of FIG. 4.

FIGS. 4, 7 and 8 best show a separate support piece 110 mounted within the front and rear torso parts piece 110 has apertures 112 which sit over mounting posts 108. The front side of support 110 abuts the ends of motor support shelf 96 as well as bosses 98 and 100. At its lower end, support piece 110 forms a rectangular bracket 114. On the back side of support piece 110, adjacent the upper end, there is an angled yolk 116. Disposed below and to the left of the yolk, as viewed in FIG. 7, is a stop 118. Immediately above rectangular bracket 114 are spaced apart mounting blocks 120, 121 and 122 for blades 124 and 125 of limit switch 126. All of the rectangular bracket 114, yolk 116, stop 118 plus limit switch blade mounts 120, 121 and 122 are integrally formed as part of support piece 110.

Inside of torso 72, a DC powered motor 130 is mounted by support shelf 96 and rectangular bracket 114, as is best illustrated in FIGS. 4 and 7. While various DC powered motors could be used, a Mabuchi FK-180S-14170 963159 motor is well adapted to this embodiment because of its relatively quiet operation. Secured to output shaft 131 of motor 130, for rotation with the shaft, is a hard rubber or vinyl motor drive member 132 which engages the rim of a considerably larger diameter drive disk 133 of a similar material. A series of gears 134, 135, 136, 137 and 138 further reduce the speed of motor 130 in a conventional manner. Drive disk 133 plus gear 134, gears 135 plus 136, and gears 137 plus 138 are mounted for rotation on bosses 98, 99 and 100, respectively.

Extending from within torso 72, through the neck opening defined by the semicircular openings with inwardly directed neck flanges 102 and 106, into head 82 is a bent shaft 140. Approximately the upper quarter 142 of the shaft is bent at an angle of about one hundred thirty-five degrees to the lower portion 144 of the shaft. Substantially the entire length of lower portion 144, from its bottom, up to the bend, is a "D" shaft. Components carried by shaft 140 are shown in the exploded perspective view of FIG. 6 as well as in FIGS. 4, 7 and 8. Mounted on the bottom of "D" shaft portion 144 is a lower cap 150 having a blind "D" bore 152 so that the cap 150 rotates with shaft 140. Cap 150 has a radially extending lever 154 adjacent its bottom and an upper cylindrical part 156. Above lower cap 150 is a generally cylindrical piece 160 having a central through bore 162 of a diameter slightly greater than the diameter of the shaft to permit rotation of piece 160 relative to the shaft. Extending radially from piece 160 is a brace 164 from which a rod 166 further extends.

Over cylindrical piece 160 is a drive member 170 with a "D" bore 172 extending through the entire member. The periphery of the drive member has a downwardly directed bevel gear segment 174 of approximately ninety degrees. Opposite gear segment 174, a stud 176 extends radially from member 170. On one side of the periphery, between gear segment 174 and stud 176 is a cutout 178. Member 170 also includes an integrally formed upper boss 179.

Positioned above drive member 170 is a collar 180 having a central through bore 182 of a diameter slightly larger than the diameter of boss 179 so that collar 180 may rotate relative to drive member 170. Collar 180 has a notch 184 of approximately fifty degrees extending down partway from the top of the collar. Depending down below notch 184 is an integrally formed crown gear segment 186 of approximately ninety degrees. Generally diametrically opposite crown gear segment 186 is an integrally formed, downwardly depending finger 188.

Engaging collar 180 is a sleeve 190 that has a smaller diameter bore 192 extending about one-third of the way up from the bottom of sleeve 190 with a larger diameter coaxial bore 194 continuing through to the top of the sleeve. Smaller bore 192 has a diameter slightly greater than the diameter of "D" shaft lower portion 144 to permit rotation of the shaft within bore 192 while providing some radial constraint. The bottom of sleeve 190 is a cylindrical boss 196 that fits into bore 182 of collar 180 permitting rotation of sleeve 190 relative to the collar. However, there is a radial rib 198 extending from boss 196 that abuts the sides of notch 184 limiting the relative rotation. Above boss 196 and rib 198, sleeve 180 has an annular groove 202 into which neck flanges 102 and 106 fit to both mount the sleeve for rotation and prevent substantial displacement along the sleeve axis. On the upper part of sleeve 190 are four, equally spaced, radial slots 204. Projecting out from the top of sleeve 190 is a pin 206.

Mounted on the "D" shaft portion above sleeve 190 is an upper cap 210 having a through "D" bore 212 and a peripheral notch 214 of approximately seventy degrees. In assembly, upper cap 210 is first put on from the bottom of "D" shaft lower portion 144 followed by sleeve 190, collar 180, drive member 170, cylindrical piece 160 and lower cap 150 with the bottom of the shaft abutting the bottom of blind bore 152 and all of the other pieces are then snugged down as illustrated in FIG. 4. "D" shaft portion 144 fits tightly within the "D" bores 152, 172 and 212. When shaft 140, together with its assembled components, is mounted in torso 72 by engagement of the semicircular flanges 102 and 106 in annular groove 202 of sleeve 190, cylindrical part 156 of lower cap 150 is rotatably supported by angled yolk 116 on support piece 110. With the shaft subassembly thus supported by neck flanges 102 and 106 and angled yolk 116, gear segment 174 is in engagement with gear 138.

Front shell 86 of head 82, as shown in FIG. 4 has an integrally formed pair of spaced apart motor brackets 216 and a cantilevered beam 218. Adjacent its bottom front, head shell 86 has a pair of inwardly directed opposed pins 220 for, the pivotal mounting of lower jaw 84. Rear head shell 87 has an integrally formed, inwardly directed wall 222 that is laterally positioned about halfway between spaced apart brackets 216. Both shells also include mating mounting posts (not shown).

Figure 11:
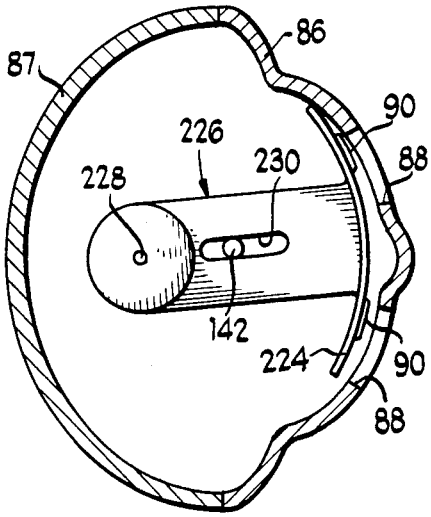
FIG. 11 is a sectional view taken generally along line 11—11 of FIG. 4.
Figure 9:
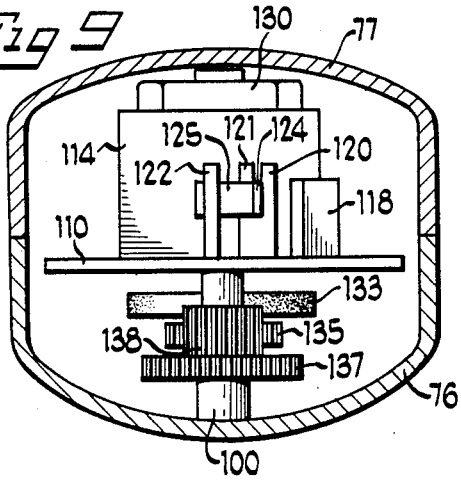
FIG. 9 is a sectional view taken generally along line 9—9 of FIG. 4.

FIG. 11 best illustrates that eyes 90 are painted or otherwise graphically applied on the outside of an arcuate plate 224 positioned behind eye openings 88. Extending rearwardly from plate 224 is an arm 226 mounted for side to side pivotal movement about the axis of a shaft 228 anchored in beam 218. Between plate 224 and shaft 228, arm 226 has an elongated slot 230. The width of slot 230 is slightly greater than the diameter of the upper portion 142 of bent shaft 140. Accordingly, as shaft 140 is rotated by engagement of drive member 170 with gear 138, bent shaft 140 pivots arm 226 to one side about the axis of shaft 228. Reversal of motor 130 will effect pivoting of arm 226 about the axis of shaft 228 to the other side. Hence, eyes 90 on the front of plate 224 will shift from side to side behind eye openings 88.

At their lower ends, front and rear head shells 86 and 87 come together, as shown in FIG. 4, to form a hollow neck 232 for head 82. The upper part of sleeve 190, which is compressible by virtue of radial slots 204 and large diameter bore 194, fits tightly within neck 232 so that the sleeve and neck are in frictional driving engagement. Accordingly, head 82, together with neck 232, will rotate along with sleeve 190 in relation to torso 72.

Whenever motor 130 is activated to rotate in either direction, it will rotate shaft 140 through output shaft 131, motor drive member 132, drive disk 133 and gears 134–138, the latter of which engages gear segment 174 of drive member 170. Initially, shaft 140 will only drive the eyes 90 to one side. However, once upper cap 210 rotates with shaft 140 through enough of an angle to bring pin 206 into engagement with one of the edges of notch 214, then sleeve 190 and head 82 will also being to rotate.

As shown in FIG. 7, right arm 80 has a mounting arbor 236 that engages collar 180 for rotation about the axis of arbor 236. The arm is secured adjacent the outside end of the arbor for rotation with the arbor. Generally centrally disposed between the ends of the arbor are a pair of spaced apart flanges defining an annular groove 238 into which flanges 104 and 107 of the front and rear parts 76 and 77, respectively, of the torso fit. Concentric with the axis of arbor 236 is a bore 240 which receives rod 166 of cylindrical piece 160. Thus, arbor 236 is mounted by both flanges 104 and 107 in annular groove 238 as well as by rod 166 in bore 240 for rotation relative to the torso about the axis of rod 166 and arbor 236. At the inside end of arbor 236 is a gear 242 which is engaged by crown gear segment 186 of collar 180.

Left arm 81 is secured to a mounting arbor 244 having a spherical surface shoulder ball joint 246. Extending out from the top and bottom of shoulder joint 246 are aligned pins 248. Shoulder ball joint 246 is received in the semicircular openings formed in the front and rear parts of the torso with pins 248 being seated in the groove 105 of front torso part 76 and the mating groove (not shown) of the rear torso part 77. Extending into the torso from shoulder ball joint 246 is an angled member 250 that extends under drive member 170 and collar 180 in toward shaft 140 such that member 150 will be engaged by downwardly depending finger 188. Accordingly, as collar 180 is driven in a counterclockwise direction, as viewed from the rear in FIG. 7, arm 81 will be pivoted away from torso 72 about the generally vertical axis of aligned pins 248.

Initial rotation of sleeve 190 will only rotate head 82. However, as rib 198, adjacent the bottom of sleeve 190, engages an edge of notch 184, collar 180, including crown gear segment 186 and depending finger 188, will also begin to rotate. Rotation of crown gear 186 in a counterclockwise direction, as viewed from the back in FIG. 7, will rotate right arm 80 upwardly from its position down alongside torso 72. Reverse rotation of collar 180 will drive the arm back down to the side of the torso. In addition, counterclockwise rotation of collar 180 will bring downwardly depending finger 188 into engagement with bent member 250 to pivot left arm upwardly and outwardly from the side of torso 72 about the axis of generally vertically aligned pins 248. When collar 180 and finger 188 reverse rotation to the clockwise direction, gravity will return left arm 81 to the position illustrated in FIG. 7.

When head 82 is driven to its leftmost position, as illustrated in FIG. 7, and the arms are in their respective lowered positions adjacent the torso, lever 154 on lower end cap 150 engages limit switch blade 124 and moves it out of engagement with blade 125 to open limit switch 126. Switch blade 124 abuts mechanical stop 118 as a safeguard so that shaft 140 and its assembly of components cannot continue to rotate in a counterclockwise direction beyond the position illustrated in FIG. 7.

As counterclockwise rotation of shaft 140 drives head 82 to its rightmost limit, gear segment 174 on drive member 170 rotates out of engagement with gear 138 bringing cutout 178 adjacent gear 138. When head 82 is in its rightmost position, the arms are in their respective upraised positions. Upon reversal of motor 130, return of gear segment 174 into engagement with gear 138 is assisted by the return of right arm 80 and left arm 81 from their respective upraised positions. Although arm 80 is driven down from its upraised position, there is a downward force resulting from gravity that is urging gear 242 on arbor 236 into engagement with crown 186 tending to rotate crown 186, and hence shaft 140 through sleeve 190 and upper cap 210, in a clockwise direction. Similarly, gravity return of left arm 81 will bring bent member 250 into contact with depending finger 188 also rotating collar 180 in a clockwise direction with finger 188 then engaging stud 176 on drive member 170 in a clockwise direction to bring gear segment 174 back into engagement with gear 138.

Lower jaw 84 is mounted for pivotal movement about pins 220 from the closed position shown in FIG. 4 to the open position shown in FIG. 5. Integrally formed along one side of lower jaw 84 is an extension 252 that extends up and into head 82. The upper end of extension 252 forms an arcuate edge 254. Below the arcuate edge are three narrow slots 256 with the upper and lower slots extending in from the forward edge and stopping short of the back edge while the middle slot extends in from the back edge and stops short of the front edge. Slots 256 permit temporary compression of the upper arcuate edge 254 relative to the pivotal axis 220 while providing sufficient bias to return the upper arcuate edge upon removal or diminishment of the compressing force.

FIG. 7 shows that mounted inside head 82, by brackets 216 and retaining wall 222, is another motor 260 that may be of the same design and manufacture as motor 130 in torso 72. Motor 260 has a metal output shaft 262 that is in driving engagement with the rim of a vinyl drive disk 264 mounted for rotation about the axis of a shaft 266 anchored in cantilevered beam 218. A fifty-five Durometer vinyl disk has been found to have sufficient wear characteristics and resiliency for use in this embodiment. As motor 260 rotates clockwise, it drives disk 264 counterclockwise with the rim of disk 264 engaging the arcuate edge 254 of the lower jaw extension to pivot lower jaw 84 to the mouth open position illustrated in FIG. 5.

Reversal of the rotation of the motor drives the jaw shut. Opening movement of the lower jaw is mechanically stopped by the upper forward edge of extension 252 abutting the back of plate 224. When movement of the jaw is mechanically stopped, metal output shaft 262 will continue to rotate and will slip on the rim of vinyl drive disk 264. Closing movement of the lower jaw is mechanically stopped by lower teeth 85 abutting upper teeth 94. Motor 260 rotates to close lower jaw 84 whenever motor 130 rotates to turn head 82 to the left when limit switch 126 will open and shut off motor 260. In the absence of limit switch 126 opening or reversal of motor 260 to open lower jaw 84, shaft 262 will slip on disk 264 when the lower and upper teeth hit.

Figure 12:
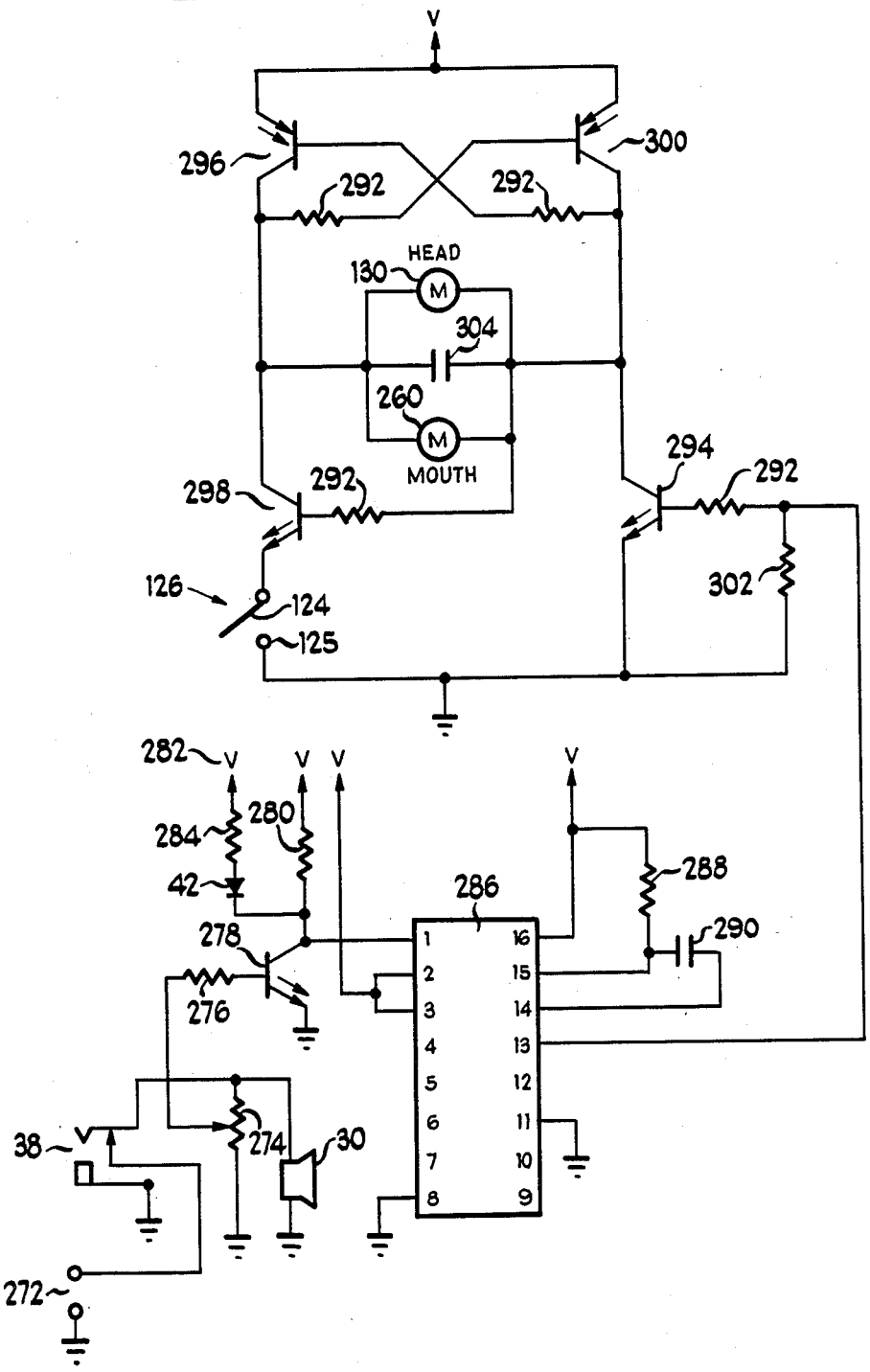
FIG. 12 is a schematic of the electronic animation control circuit.

Wiring (not shown) for motor 260 passes down into torso 72 through a groove (not shown) in sleeve 190 and together with wiring (not shown) for motor 130 passes down through left leg 75 for connection to the female plug (not shown) in left foot 79. Connecting the female plug with male plug 29 then connects motors 130 and 260 with the circuit of FIG. 12. Alternative inputs to speaker 30 are shown from audiocassette or microphone input jack 38 and a synthesized voice input 272. Potentiometer 274, which is operated by sensitivity control knob 40, permits varying the sensitivity of the electrical signal from the inputs through a 4.7K ohm resistor 276 establishing the drive current to a 2N5306 Darlington transistor 278.

Another 4.7K ohm resistor 280 is connected between the collector of the Darlington transistor 278 and power supply 282 to establish a current flowing through the Darlington transistor. Also connected between the power supply and the Darlington transistor is a one hundred eighty ohm resistor 284 and LED 42 which provides a visual indication that the circuit is working and receiving a sufficient input from the audio source. Transistor 278 feeds into a 74123 dual retriggerable one-shot 286 which is also connected to the power supply. A 74122 single retriggerable one-shot could be used instead of the dual retriggerable one-shot.

To provide an electrical time constant equivalent to the mechanical time constant for opening lower jaw 84, there is a 15K ohm resistor 288 and a 0.15 microfarad capacitor 290 connected through the power supply. The values for resistor 288 and capacitor 290 are selected for best responsiveness with the Mabuchi FK-180S-14170 963519 motors 130 and 260 used in this embodiment. Thus, the resulting signal will be based on all audio signals above and below predetermined amplitude thresholds and be of a duration at least long enough to effect opening of lower jaw 84.

A one hundred ohm resistor 292 establishes a drive current for the NPN 2N6038 Darlington transistor 294 and another resistor 292 establishes the drive current for a PNP 2N6034 Darlington transistor 296. Whenever one-shot 286 is triggered, motors 130 and 260 are turned on by transistors 294 and 296 in the direction to drive the mouth open rom its closed, at rest, position and the head toward the right from its full-left, at rest, position. Another set of Darlington transistors 298 and 300, which are similar to transistors 294 and 296, respectively each associated with a drive current established by resistor 292. Transistors 294 and 296 reverse motors 130 and 260 to drive the head and jaw, respectively, back to their at rest positions upon termination of the pulse signal emanating from one-shot 286. The resulting movements of the character's lower jaw 84, eyes 90, head 82, right arm 80 and left arm 81, shown in FIGS. 1, 4, 5, 7, and 11, creates the impression that such animation is synchronized with the character's speech.

Whenever the jaw is closed and the head in its full-left position, lever 154 urges blade 124 of limit switch 126 out of contact with blade 125, as illustrated in FIG. 7, to open the limit switch and shut off motors 130 and 260 to reduce wear. However, since there is always some voltage in this transistor logic circuit, an eight hundred twenty ohm dropping resistor 302 is interjected between one-shot 286 and the transistor motor switches to prevent turning the motors on at the low of the TTL circuit. In addition, there is a 0.1 microfarad capacitor 304 across the motors of compensate for motor brush noise.

Figure 13:
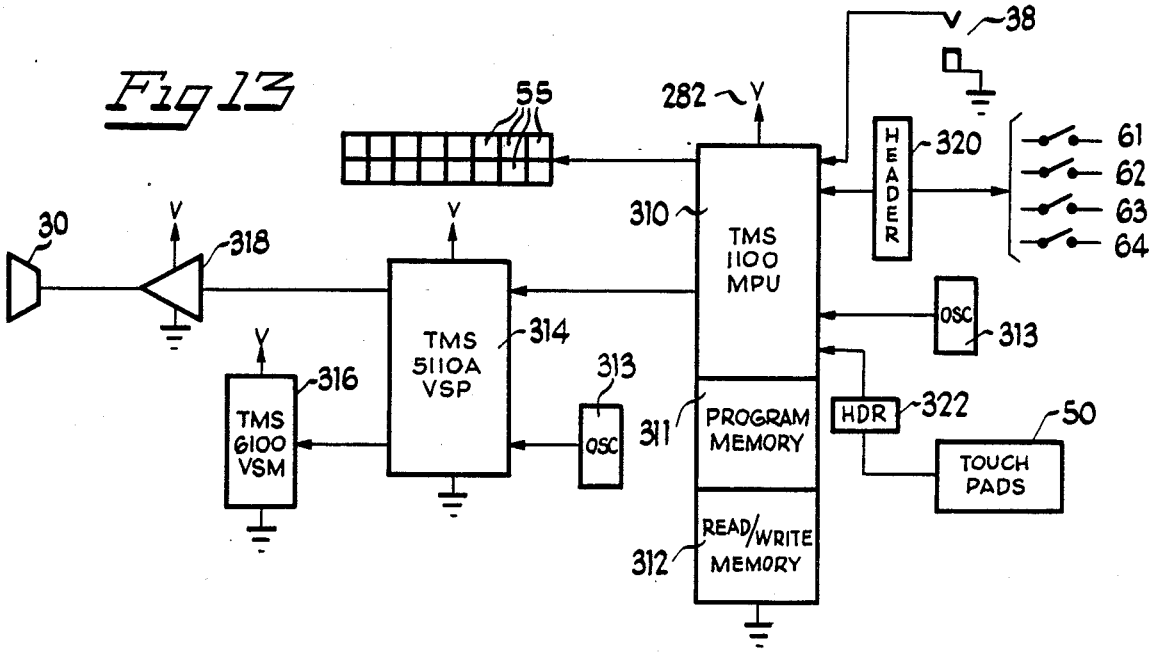
FIG. 13 is a block diagram of the game control components.

FIG. 13 shows exemplary electronic components that may be housed within base 22 for implementing the game play portion of the present invention. A microprocessor 310 such as Texas Instruments Model TMS 1100 having a nonvolatile program memory 311 and a read/write memory 312 is connected to power supply 282 and to an external oscillator drive 313 for clocking. Program memory 311 stores basic game and response programs while the read/write memory stores current game information such as the number of players, which player's turn it is to respond, and the players' scores. Also connected to the power supply and to microprocessor 310 is a voice synthesizer 314 such as Texas Instruments Model TMS 5110A which also has an external oscillator drive 313 for clocking. Voice synthesizer 314 is connected to a vocabulary memory 316, such as Texas Instruments TMS 6100, that is connected to the power supply. In addition, voice synthesizer 314 is connected to an amplifier 318 which is connected to the power supply and to speaker 30. Voice synthesizer 314 receives addresses directly from the microprocessor to give instructions, ask questions, interject humor and keep score through speaker 30 using the vocabulary contained in memory 316.

Input from player buttons 61, 62, 63 and 64 shown in FIG. 1, is communicated to microprocessor 310 through header 320. The thirty-two switches of touch pad 50 input to microprocessor 310 through another header 322. There may be additional input to microprocessor 310 from an audio tape player connected through jack 38. Tape recordings that interact with microprocessor 310 and voice synthesizer 314 can, for example, provide many more questions than could be economically contained in the programmed memory of the microprocessor. Microprocessor 310 controls each light 55 located, as shown in FIG. 1, beneath each square 54 in base 22.

Figure 14:
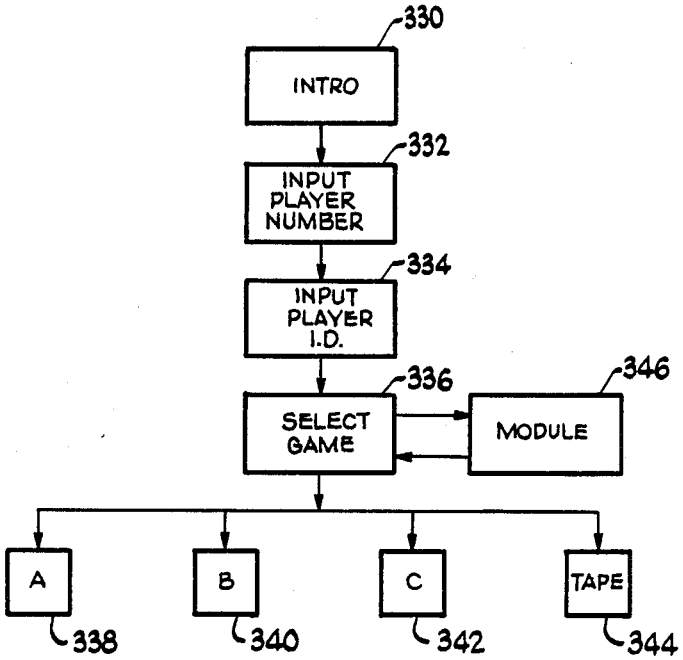
FIG. 14 is a flow chart illustrating a game initiation and selection sequence.

As illustrated by the flow chart of FIG. 14, at the start of the game, following an introductory programmed routine 330, players are requested at 332 to indicate by serial depression of the appropriate number of buttons 61, 62, 63 and 64 shown in FIG. 1, how many players will be involved. Depression of the player buttons in response to this routine identifies the player by button number, one, two, three or four, as well as by the color associated with the button. Players are then requested by another program routine 334 to further identify themselves by initials or as "MOM" or "DAD" by pressing down upon the appropriate squares of touch pad 50. A routine at 336 then requests the players to indicate, by depression of one of the alphabet letters in key pad 50, which game they desire to play. FIG. 14 identifies three games "A", "B" and "C" as 338, 340 and 342, respectively. A "TAPE" game 344 would be orally identified during routine 336 by an alphabet letter such as "Z". To further increase the versatility of the present invention, game modules 346 may be plugged into the game. The modules comprise additional programmed memory containing instructions, questions and remarks for additional games.

Figure 15:
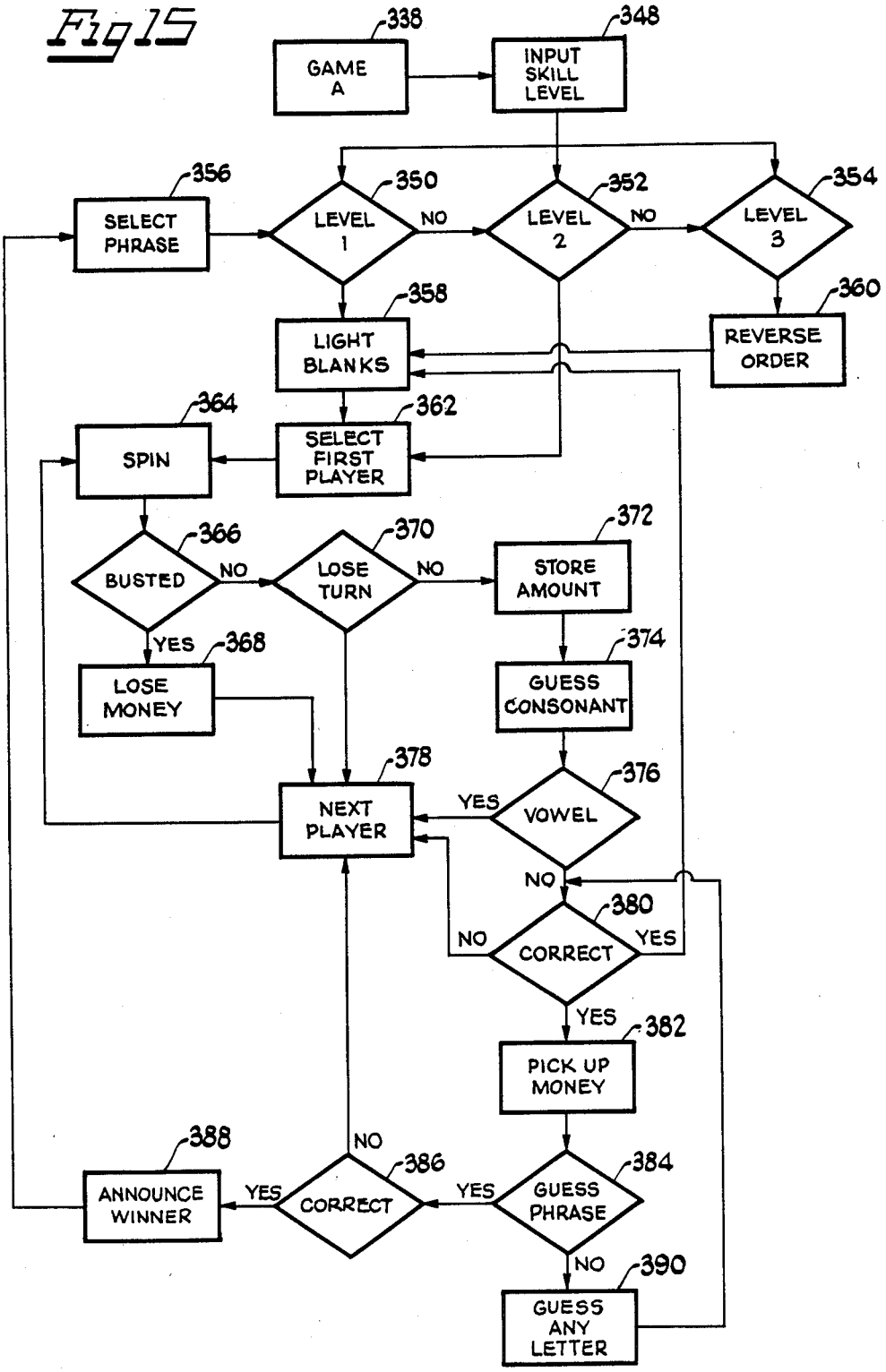
FIG. 15 is a flow chart illustrating the play of one of the games stored in the program memory.

One of the games contained in the program memory of microprocessor 310 is a guess the letter and eventually the entire phrase game called "FAMOUS PHRASES" illustrated by the flowchart of FIG. 15. Stored within the program memory are a multitude of phrases identifying persons, places, things, quotations and book titles. Because of the gridwork of spaces 54 being two rows of eight spaces, the total letter and space content of the phrases is limited to sixteen or less without any one word being longer than eight letters.

Prior to starting the first round, the players are requested at 348 to indicate the desired difficulty level by depression of an appropriate button 61, 62 or 63. In the first difficulty level 350, all of the letters of the phrases appear in their correct order with blanks between words being indicated. A second difficulty level 352 eliminates the identification of blanks while in the third difficulty level 354, all of the letters of the phrase are reversed.

Microprocessor 310 randomly selects a phrase from program memory at 356 after checking with the read/write memory to determine that the phrase has not previously been used in the round being played. The microprocessor then lights the blanks at 358 if required and reverses the order of the letters at 360 if necessary. Character 20 also then announces the category involved and the amount of play money to be won by the player correctly guessing the phrase. Players are then informed, if appropriate for the selected difficulty level, of the number of words and letters in the phrase to be guessed by the character's instruction to "FILL IN THE BLINKING BLANKS" and a corresponding indication which of squares 54 shown in FIG. 1 are blanks by microprocessor 310 actuating the appropriate lights 55 for a predetermined amount of time. While the lights 55 are on, one of the players conveniently marks the blank squares using writing instrument 57 that may later be erased.

A player is randomly selected to start the first round and the microprocessor keeps track of the next player to start the next round at 362. For rotating the starting order from round to round of the game, the read/write memory of microprocessor 310 keeps track of how many players are in the game and which player started the last round. Players are instructed to "SPIN" at 364 by depressing the appropriate one of button 61, 62, 63 or 64 at the beginning of each round and after each guess, whether correct or not. Generally, a player that has just successfully guessed a letter will wish to continue but may pass by permitting the next player to depress that player's assigned button.

Depressing a button in response to the "SPIN" instruction initiates a sequence where lights 55 beneath squares 54 serially cycle from square to square until one of the squares is randomly indicated. The area on removable insert 56 aligned with the indicated square may indicate that the player is "BUSTED" 366 and will "LOSE MONEY" 368 accumulated up to that point in the round or that the player must "LOSE A TURN" 370. If the player is not "BUSTED" or does not "LOSE A TURN", a value of play money that the player will accumulate should the player correctly guess a letter will be indicated by the lit square and stored at 372.

The microprocessor next instructs the starting players to start the round by guessing a consonant at 374. To facilitate differentiating consonants could be colored blue, for squares 50 illustrated in FIG. 1 containing consonants could be colored blue, for example, and those containing vowels be colored red. Accordingly, an appropriate instruction from the character would be "PICK A BLUE LETTER". A determination of whether a vowel or consonant was selected is made at 376. Should a player inappropriately press a vowel square, the character advises "I SAID A BLUE LETTER, NOT A RED LETTER—LOSE A TURN" or the like and play proceeds to the next player at 378.

When a player, by pressing down upon the appropriate letter square of touch pad 50 correctly guesses a letter in the phrase as determined at 380, the character orally indicates that a letter has been correctly guessed with some humorous remark. At the same time, the location of the letter, including multiple locations of the same letter, is visually indicated by lighting up the appropriate square or squares at 358 through the lights 55 controlled by microprocessor 310. The player's turn continues for as long as the player correctly guesses letters in the phrase and does not spin a "BUSTED" or "LOSE A TURN". After each correctly guessed letter, the amount of play money earned is computed by multiplying the occurrences of the letter times the amount stored at 372 and the player is instructed to pick up the play money at 382. A request is then made of the player at 384 to determine if the player wishes to attempt to guess the entire phrase. If the player does wish to make such an attempt, the player depresses the "YES" square of touch pad 50 and then proceeds to spell each word of the phrase by depressing the appropriate letters on the touch pad in their correct order.

As a player inputs the letters for a phrase by depressing the appropriate squares of touch pad 50, character 20 orally spells the phrase through speaker 30, as for example, "T-H-E-B-I-G-A-P-P-L-E". Character 20 then announces whether or not the phrase has been correctly spelled. Thus, the vocabulary for voice synthesizer 314 need not contain each of the words comprising the phrases stored in the program memory portion of microprocessor 310. Correctly guessing the entire phrase as determined at 386 entitles a player to retain all of the play money acquired during the round and that player is announced as the winner at 388. The game then starts another round by selecting another phrase at 356 that has not been used in the game. Shutting off the game erases the data on phrases used from the read/write memory 312.

Should a player fail in an attempt to guess the entire phrase, the player's turn is lost but not the play money acquired up to that point and play proceeds with the next player at 378. In the event a player chooses not to try for the entire phrase, the player is entitled to guess any letter, including a vowel, at 390. If a correct letter is guessed as determined at 380, the sequence returns to computation and instruction to pick up money at 382. However, if the guess is not correct, the game proceeds with the next player at 378.

Another game playable with the present embodiment is called "WATCH THE WORD" and has its own removable insert similar to insert 56 illustrated in FIG. 1. In this game, players try to be the first to guess a single word with the microprocessor giving clues by indicating letters that appear in the word. At the onset of a round, players are requested to guess a word for a specific amount of play money with a single letter being orally announced through speaker 30 illustrated in FIG. 2 and the location of the letter being visually indicated by lighting up the appropriate LED 55 under one of squares 54 shown in FIG. 1. All of the players have a predetermined amount of time in which to hit their assigned buttons 61, 62, 63 and 64 with the first to do so getting a chance to correctly spell out the entire word. If none of the players try, or if a player tries and does not correctly guess the word, an additional letter and its location are given as the second clue, etc. until only one letter in the word remains to be guessed.

As with the previous game, "WATCH THE WORD" has three difficulty levels. In the first level, blanks are indicated to identify the length of the word and the letters appear in their correct order. The second difficulty level reverses the order of the letters while the third level has the letters in their normal order but eliminates the indication of the blanks so that the length of the word is not known. In "WATCH THE WORD", only one row of eight squares 54 are used so that only words of eight or less letters are used.

Yet another game called "ON THE BUTTON" may be played with the present embodiment. A separate removable insert similar to insert 56 illustrated in FIG. 1 is also provided for "ON THE BUTTON". For this game, players are called out by their initial, the color of their assigned button, and/or the number of their assigned button. If, at the same time that the player is called out orally by initial, color and/or number, the character's mouth, or more particularly lower jaw 84, moves, then the player must depress the assigned button. Should the player fail to depress the assigned button when required, or depress the assigned button when the character's mouth does not move or when an opponent has been called out, the player is then out of the round. Play continues with players being called out at an ever increasing speed until only one player remains and is the winner of the round. Again, three difficulty levels may be provided in which the player is first identified only by initials, secondly by both initials and the color of the assigned button and finally by any one of the player's initials or the color or number of the assigned button.

Figure 16:
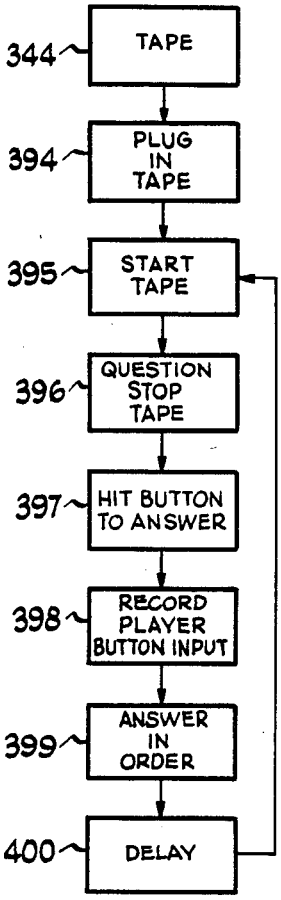
FIG. 16 is a flow chart illustrating the interfacing of a audio tape game with the program memory.

FIG. 16 illustrates a flowchart for an audio tape game 344 that may include a vast number of questions. Any commercially available tape player, except an earphone only player that does not have the necessary jack connection may be plugged into jack 38 as indicated at 394. Microprocessor then instructs the players to "START THE TAPE" at 395. A question on the tape is then asked and at the end of the question, the players are instructed to "STOP THE TAPE" at 396. Depression of the stop button on the audio tape player addresses microprocessor 310, through jack 38, to continue through voice synthesizer 314 with an instruction such as "IF YOU KNOW THE ANSWER, HIT YOUR BUTTON" at 397. The read/write memory portion of microprocessor 310 will then keep track at 398 of the order of the depression of buttons 61, 62, 63 and 64 shown in FIG. 1. After an interval following one player's button being hit, an appropriate remark such as "DOESN'T ANYBODY ELSE KNOW THE ANSWER?" may be made.

When all of buttons 61, 62, 63 and 64 are depressed or a predetermined amount of time elapses and no further buttons are depressed, an instruction is then given at 399 for each player to announce their answer, in the order the players depressed their respective buttons. Following a sufficient time interval at 400 for announcement of the last player's response, an instruction is again given at 395 through voice synthesizer 314 to "START THE TAPE". The correct answer to the pending question is then played and the first player having the correct answer receives an amount of play money as announced at the beginning of the question together with a lesser amount from every other player giving an incorrect answer. Any player subsequent to the first player having the correct answer neither wins nor loses money in that round. After a predetermined number of rounds, the player with the most play money wins.

While a particular embodiment of the present invention has been shown and described, along with exemplary games, changes and modifications as well as additional games will occur to those skilled in the art. It is intended in the following claims to cover all such changes and modifications as fall within the true spirit and scope of the present invention.

What is claimed as new and desired to be secured by Letters Patent is:

1. A game including:

a base;

an animated character mounted on the base;

player input means carried by the base;

the player input means including a first set of input means common to all players and a second set of input means individual to each player;

program means containing game play instructions;

audio means; and means interfacing the animated character, player input means, program means and audio means so that the character effectively hosts play of the game including giving instructions on play of the game.

2. The game of claim 1 in which the first set of input means includes means for identifying each letter of the alphabet.

3. A game including:

a base;

an animated character mounted on the base;

player input means carried by the base;

program means containing game play instructions;

audio means;

means interfacing the animated character, player input means, program means and audio means so that the character effectively hosts play of the game including giving instructions on play of the game; and visual indicator means comprising a gridwork of individually lightable spaces.

4. The game of claim 3 including means for erasably marking on the individual spaces.

5. The game of claim 3 including:

insert means removably applicable to the base adjacent the gridwork;

the insert means containing further elements of instruction for the game; and each of the elements of instruction on the insert being indexed to one of the individually lightable spaces comprising the gridwork.

6. An animated character including:

motor means contained within the character;

a rotatable shaft carried within the character;

first rotating means mounted on the shaft for rotation with the shaft;

the first rotating means transmitting rotation from the motor to the shaft;

second rotating means mounted on the shaft for rotation with the shaft;

first animation means carried by the shaft for rotation relative to the shaft;

the first animation means being engageable by the second rotating means to transmit rotation to the first animation means after a predetermined amount of rotation by the second rotating means in one direction;

second animation means carried by the shaft for rotation relative to the shaft; and the second animation means being engageable by the first animation means to transmit rotation to the second animation means after a predetermined amount of rotation by the first animation means in one direction.

7. The character of claim 6 including:

a torso;

arms mounted on the torso for movement relative to the torso;

a head mounted on the torso for movement relative to the torso;

eyes carried by the head for movement relative to the head;

the motor means being contained within the torso; and the rotatable shaft extending from within the torso into the head.

8. The character of claim 7 in which:

the shaft moves the eyes;

the first animation means moves the head; and the second animation means moves the arms.

9. The character of claim 7 in which the first animation means comprises a sleeve that is carried by the torso for rotation relative to the torso and engages the head for rotation with the head.

10. The character of claim 7 in which:

one of the arms is mounted for rotation relative to the torso;

arm mounting means for the one arm includes a gear; and the second animation means includes a gear segment engaging the arm mounting means gear.

11. The character of claim 7 in which:

one of the arms is mounted for pivotal movement toward and away from the torso;

the arm mounting means for the one arm includes a member extending into the torso; and the second animation mean includes a finger engageable with the arm mounting means member.

12. The character of claim 7 in which:

the head includes a lower jaw mounted for pivotal movement relative to the head;

the lower jaw has an extension within the head;

the extension has an upper edge;

another motor means having an output shaft is mounted within the head;

a disk having a rim is mounted for rotation within the head;

the output shaft of the other motor means engages the rim of the disk; and the rim of the disk engages the upper edge of the extension to pivot the lower jaw.

13. The character of claim 12 including at least one slot extending partially across the extension below the upper edge permitting compression of the upper end relative to the portion of the extension between the slot and the pivotal mounting of the lower jaw upon rotation of the disk.

* * * * *